US008147230B2

(12) United States Patent
Chu

(10) Patent No.: US 8,147,230 B2
(45) Date of Patent: Apr. 3, 2012

(54) SCROLL COMPRESSOR HAVING REARWARDLY DIRECTED FLUID INLET AND OUTLET

(76) Inventor: Henry C. Chu, Orange, CA (US)

( * ) Notice: Subject to any disclaimer, the term of this patent is extended or adjusted under 35 U.S.C. 154(b) by 457 days.

(21) Appl. No.: 12/384,523

(22) Filed: Apr. 6, 2009

(65) Prior Publication Data

US 2010/0254843 A1 Oct. 7, 2010

(51) Int. Cl.
*F01C 1/02* (2006.01)
*F03C 2/00* (2006.01)
*F03C 4/00* (2006.01)

(52) U.S. Cl. ..... 418/55.1; 418/55.5; 418/57

(58) Field of Classification Search ..... 418/55.1–55.6, 418/57, 270

See application file for complete search history.

(56) References Cited

U.S. PATENT DOCUMENTS 4,411,604 A 10/1983 Terauchi
4,514,150 A * 4/1985 Hiraga et al. ..... 418/55.1
4,540,355 A 9/1985 Sakaki et al.
4,575,319 A 3/1986 Terauchi
4,597,724 A 7/1986 Sato et al.
4,642,034 A * 2/1987 Terauchi ..... 418/55.1
4,645,436 A 2/1987 Sakamoto
4,673,340 A * 6/1987 Mabe et al. ..... 418/55.1
4,824,346 A * 4/1989 Hiraga et al. ..... 418/55.5
4,890,987 A * 1/1990 Sato et al. ..... 418/55.1
4,913,635 A 4/1990 Ochiai et al.
4,936,756 A 6/1990 Shimizu et al.
5,269,661 A 12/1993 Iizuka et al.
5,660,538 A 8/1997 Higashiyama et al.
6,461,120 B2 10/2002 Harakawa et al.

* cited by examiner

*Primary Examiner* — Theresa Trieu
(74) *Attorney, Agent, or Firm* — Charles E. Baxley

(57) ABSTRACT

A scroll compressor includes a chamber formed in a casing and a compartment formed in a rearward end, a fixed scroll mounted within the casing and having a spiral scroll element extended from a base plate, and an orbiting scroll rotatably disposed in the casing, and having a spiral scroll element extended from a carrier plate and arranged to form a line contact between the spiral scroll elements, and the fixed scroll includes an inlet mouth and a fluid passage formed through the base plate, and the casing includes an inlet port and an outlet port formed in the rearward end for easily and quickly coupling to the tubings of the vehicle with pipings without bending or folding the pipings.

4 Claims, 6 Drawing Sheets

SCROLL COMPRESSOR HAVING REARWARDLY DIRECTED FLUID INLET AND OUTLET

BACKGROUND OF THE INVENTION

1. Field of the Invention

The present invention relates to a scroll type fluid displacement apparatus, and more particularly to a scroll type compressor including a fluid inlet and a fluid outlet disposed or arranged rearwardly or at the rear portion of the compressor for allowing the compressor to be easily and quickly coupled to the tubings or pipings of the vehicle with the other tubings or pipings without bending or folding the other tubings or pipings, and for allowing the compressor to be easily and quickly secured or assembled or mounted within the tiny engine chamber of the vehicle.

2. Description of the Prior Art

Typical scroll compressors comprise a compressor housing including a front end plate member attached to the upper portion of a cup shaped casing, a fixed scroll member mounted within the cup shaped casing, and an orbiting scroll member rotatably disposed within the inner chamber of the cup shaped casing and disposed or arranged at an angular and radial offset from the fixed scroll member for forming at least one pair of sealed off fluid pockets, in which the fluid pockets are moved inwardly along the spiral scroll members and changed in volume or displaced by relative orbital motion between the spiral scroll members.

For example, U.S. Pat. No. 4,411,604 to Terauchi, U.S. Pat. No. 4,540,355 to Sakaki et al., U.S. Pat. No. 4,575,319 to Terauchi, U.S. Pat. No. 4,597,724 to Sato et al., U.S. Pat. No. 4,645,436 to Sakamoto, U.S. Pat. No. 4,913,635 to Ochiai et al., U.S. Pat. No. 5,269,661 to Iizuka et al., and U.S. Pat. No. 5,660,538 to Higashiyama et al. disclose eight of the typical scroll type fluid displacement apparatuses each also comprising a fixed scroll member solidly mounted within a cup shaped casing of a compressor housing, and an orbiting scroll member rotatably disposed within the inner chamber of the cup shaped casing for forming at least one pair of sealed off fluid pockets between the spiral scroll members.

Normally, the fluid inlet and the fluid outlet are disposed or arranged upwardly or at the upper portion of the compressor housing, and a number of tubings or pipings are required to be provided and coupled to the fluid inlet and the fluid outlet of the compressor housing and should be bent or folded for coupling to the other tubings or pipings of the vehicle.

However, in the tiny engine chamber of the vehicle, it will be difficult to engage the tubings or pipings into the tiny engine chamber and to couple the other tubings or pipings to the fluid inlet and the fluid outlet of the compressor housing, and it is required to bend or fold the other tubings or pipings before the fluid outlet of the compressor housing may be coupled to the tubings or pipings of the vehicle.

U.S. Pat. No. 4,936,756 to Shimizu et al. discloses another typical scroll type fluid displacement apparatus also comprising a fixed scroll member mounted within a cup shaped casing of a compressor housing, and an orbiting scroll member rotatably disposed within the inner chamber of the cup shaped casing for forming at least one pair of sealed off fluid pockets between the spiral scroll members, a suction gas inlet pipe inserted through the rear end of the housing, and a discharge gas outlet pipe also disposed or arranged upwardly or at the upper portion of the compressor housing, in which the upward discharge gas outlet pipe also may not be easily coupled to the tubings or pipings of the vehicle with the other tubings or pipings which are also required to be bent or folded to couple the fluid outlet of the compressor housing to the tubings or pipings of the vehicle.

U.S. Pat. No. 6,461,120 to Harakawa et al. discloses a further typical scroll type fluid displacement apparatus also comprising a fixed scroll member mounted within a cup shaped casing of a compressor housing, and an orbiting scroll member rotatably disposed within the inner chamber of the cup shaped casing for forming at least one pair of sealed off fluid pockets between the spiral scroll members, a suction gas inlet pipe provided in the front end of the housing, and a discharge gas outlet pipe disposed or arranged in the rear end of the housing.

However, the inner structure of the compressor housing should be greatly or vastly changed or modified to form the gas flowing passage within the inner portion of the compressor housing, such that the whole typical scroll type fluid displacement apparatus should be redesigned and manufactured, and such that the manufacturing cost for the typical scroll type fluid displacement apparatus will be greatly increased.

The present invention has arisen to mitigate and/or obviate the afore-described disadvantages of the conventional scroll compressors.

SUMMARY OF THE INVENTION

The primary objective of the present invention is to provide a scroll compressor including a fluid inlet and a fluid outlet disposed or arranged rearwardly or at the rear portion of the compressor for allowing the compressor to be easily and quickly coupled to the tubings or pipings of the vehicle with the other tubings or pipings without bending or folding the other tubings or pipings, and for allowing the compressor to be easily and quickly secured or assembled or mounted within the tiny engine chamber of the vehicle.

In accordance with one aspect of the invention, there is provided a scroll compressor comprising a compressor housing including a casing having a chamber formed in the casing for receiving a fluid, and having a rearward end, and having a compartment formed in the rearward end and communicative with the chamber of the casing, the casing including an inlet port formed in the rearward end of the casing, and including an outlet port formed in the rearward end of the casing and communicative with the compartment of the casing, a fixed scroll mounted within the chamber of the casing, and including a base plate fixed to the casing for separating the compartment and the chamber of the casing from each other, and including a spiral scroll element extended from the base plate and disposed and located within the chamber of the casing, and an orbiting scroll rotatably disposed and located within the chamber of the casing, and including a carrier plate, and including a spiral scroll element extended from the carrier plate and located within the chamber of the casing and arranged at an angular and radial offset from the spiral scroll element of the fixed scroll and arranged to form a line contact between the spiral scroll elements of the fixed scroll and the orbiting scroll, and arranged for forming a sealed off fluid pocket within the chamber of the casing, and the fixed scroll includes an inlet mouth formed therein and coupled to the inlet port of the casing and separated from the compartment of the casing for receiving the fluid from the inlet port of the casing, and includes a fluid passage formed through the base plate and communicative with the inlet mouth for allowing the fluid to flow from the inlet port of the casing into the inlet mouth of the base plate, and then into the fluid pocket, and then to be compressed into a compressed fluid by a relative orbital motion between the spiral scroll elements of the fixed scroll and the orbiting scroll, and the fixed scroll includes a discharge port formed through the base plate and communicating the fluid pocket with the compartment of the casing for allowing the compressed fluid to flow from the fluid pocket into the compartment of the casing, and then to flow out through the outlet port of the casing.

The fixed scroll includes a protrusion extended from the base plate and extended and located opposite to the spiral scroll element of the fixed scroll and disposed and located within the compartment of the casing and engaged with the rearward end of the casing for spacing the base plate from the rearward end of the casing and for forming the compartment of the casing as a discharge chamber. The inlet mouth is preferably formed through the protrusion of the fixed scroll.

The base plate includes a valve device attached to the base plate and engaged with the discharge port of the base plate for limiting the fluid to flow from the fluid pocket of the casing through the discharge port of the base plate and into the compartment of the casing, and to prevent the fluid from flowing backward from the compartment into the fluid pocket of the casing. The valve device is preferably a leaf valve device and acted as a check valve device.

The compressor housing includes a front end plate mounted to a front portion of the casing, and includes an orifice formed in the front end plate, a drive shaft rotatably received and supported in the orifice of the front end plate, a disc rotor mounted to the drive shaft and disposed within the chamber of the casing, and a magnetic clutch coupled to the drive shaft for transmitting a rotation force to the drive shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
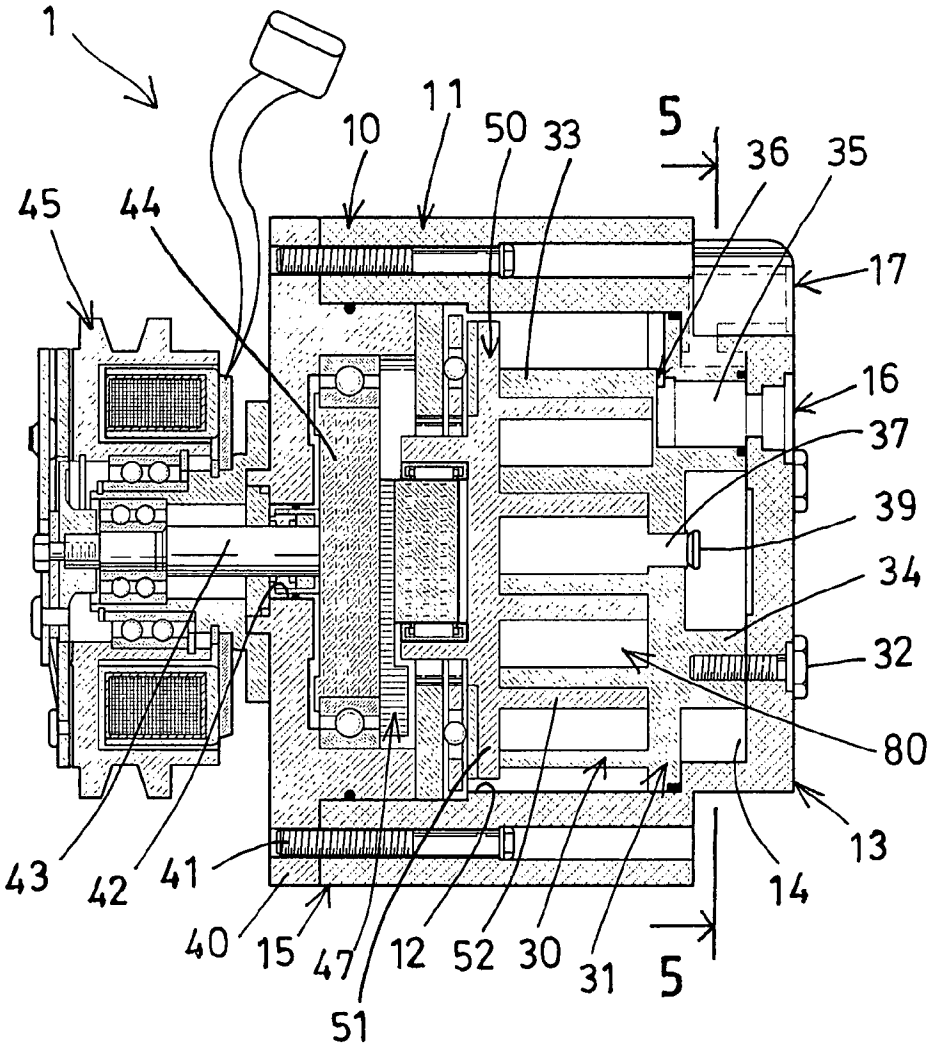
FIG. 1 is a cross sectional view of a scroll type compressor in accordance with the present invention.
Figure 2:
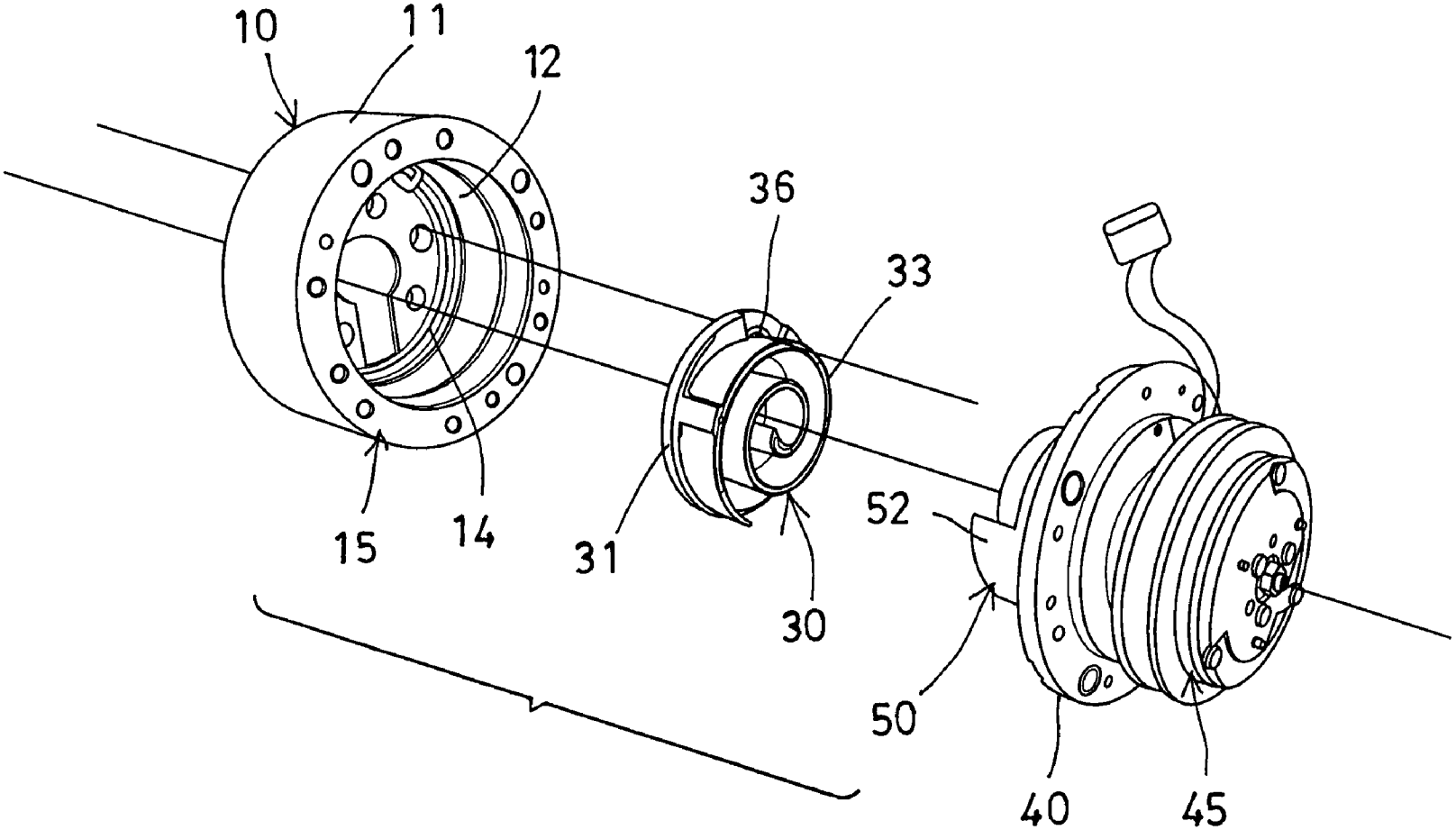
FIG. 2 is a partial exploded view as seen from the front portion of the scroll type compressor.
Figure 3:
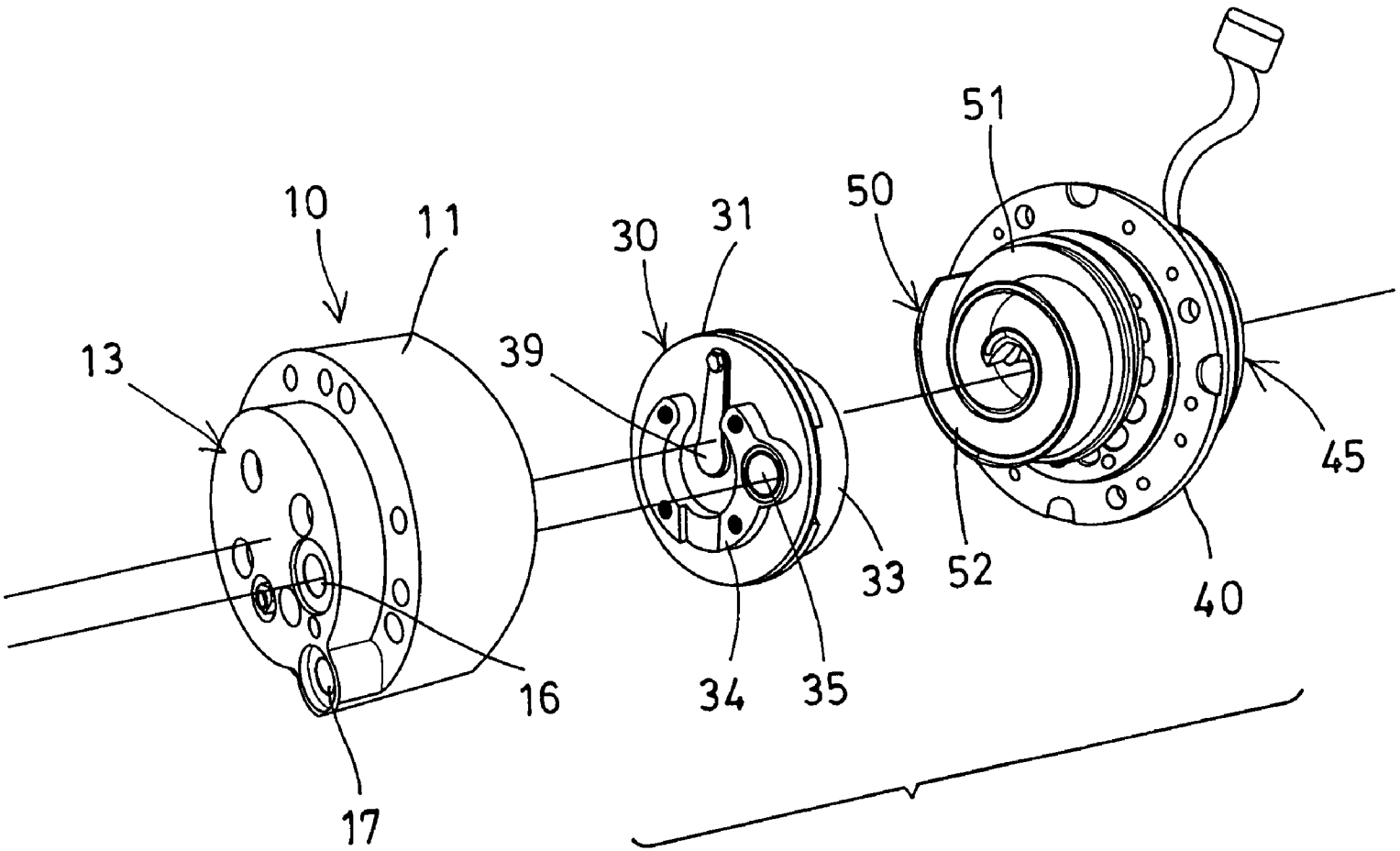
FIG. 3 is another partial exploded view similar to FIG. 2, as seen from the rear portion of the scroll type compressor.
Figure 4:
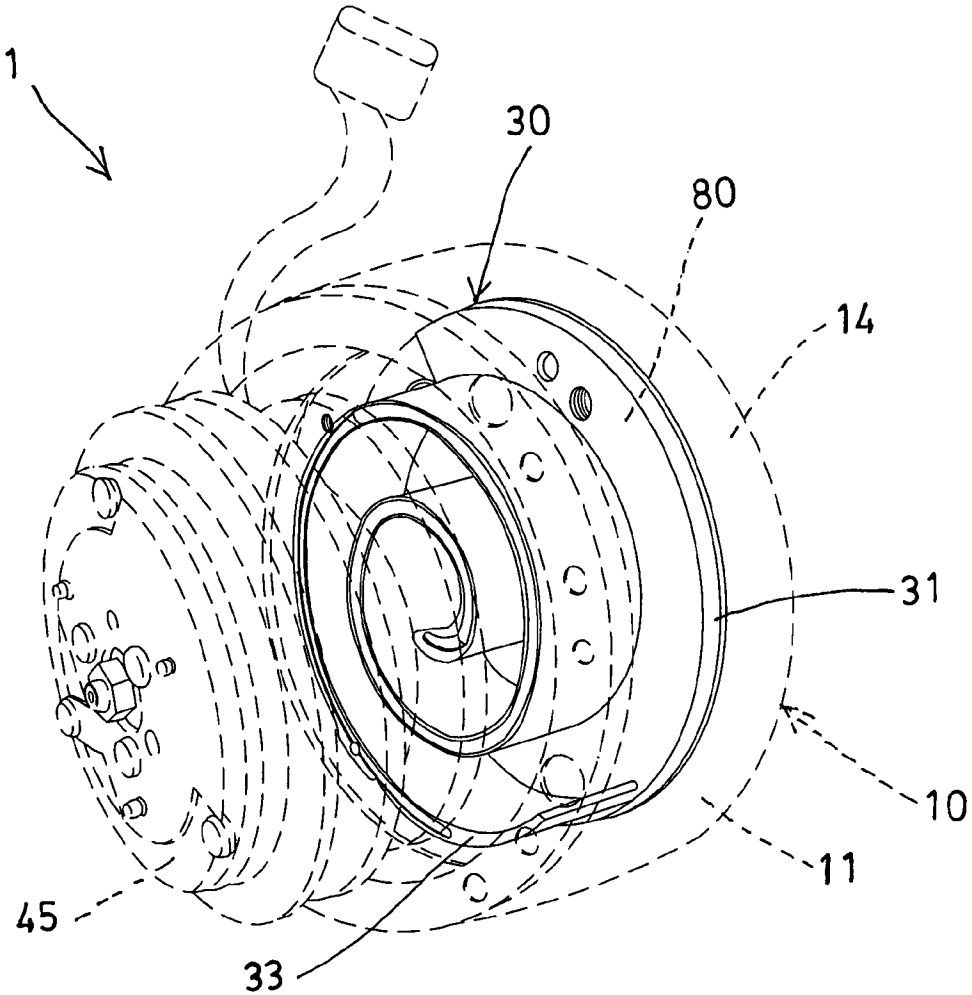
FIG. 4 is a partial perspective view illustrating the rear portion of the fixed scroll member of the scroll compressor.
Figure 5:
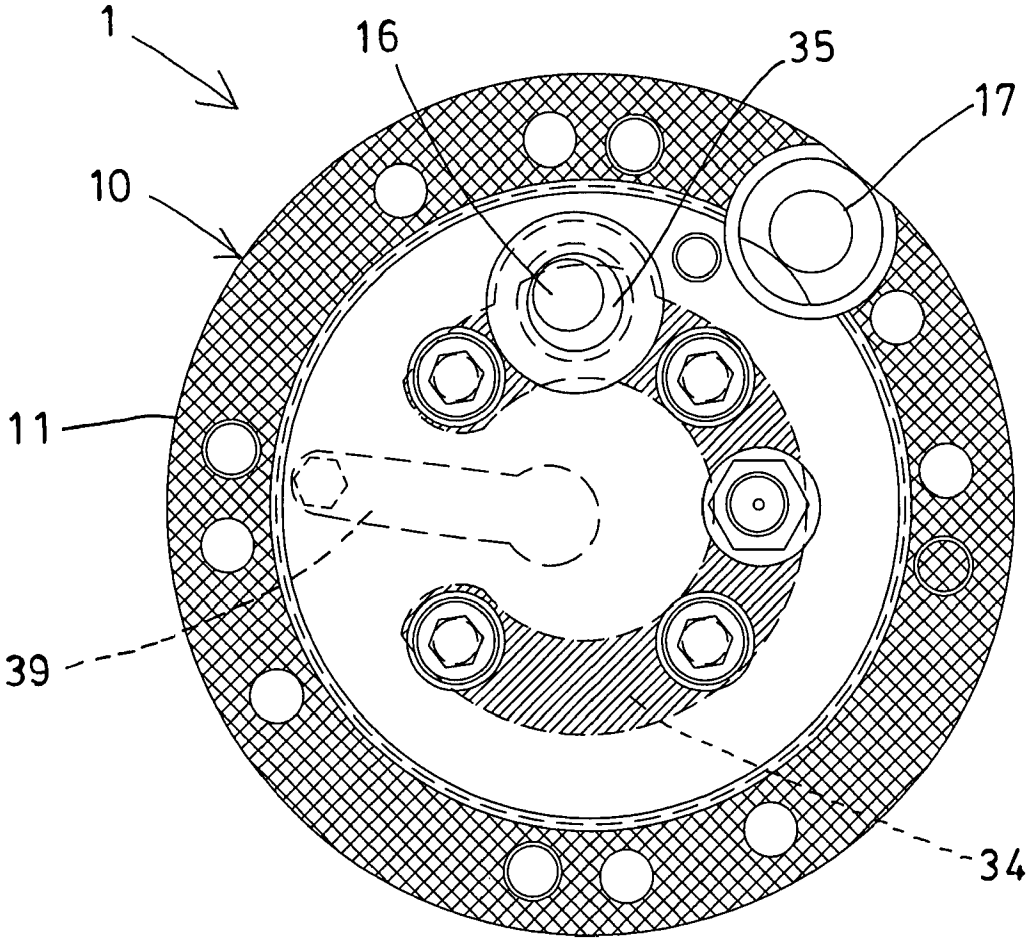
FIG. 5 is a cross sectional view of the scroll type compressor, taken along lines 5-5 of FIG. 1.

Referring to the drawings, and initially to FIGS. 1-5, a scroll compressor 1 in accordance with the present invention comprises a compressor housing 10 including a cup shaped casing 11 having a chamber 12 formed in the cup shaped casing 11, and having a rear portion or rearward end 13, and having a compartment 14 formed in the rearward end 13 and communicating with the chamber 12 of the casing 11. A fixed scroll 30 is mounted within the chamber 12 of the cup shaped casing 11, and includes a base plate 31 fixed to the casing 11 with one or more latches or fasteners 32, and includes a spiral scroll element 33 extended outwardly from the base plate 31 and disposed and located within the chamber 12 of the casing 11.

A front end plate 40 is attached or mounted to the front portion 15 of the casing 11 with one or more latches or fasteners 41 for closing the chamber 12 of the casing 11, and includes an orifice 42 formed in the center portion thereof for rotatably receiving or supporting a drive shaft 43, a disc rotor 44 is attached or mounted to the drive shaft 43 and disposed and located within the chamber 12 of the casing 11, a magnetic clutch 45 is attached or mounted or coupled to the drive shaft 43 for transmitting a rotation force to the drive shaft 43. An orbiting scroll 50 is rotatably disposed and located within the chamber 12 of the casing 11, and includes a carrier plate 51 mounted or coupled to the disc rotor 44 and/or the drive shaft 43 with an eccentric coupling device 47 for allowing the orbiting scroll 50 to be rotated eccentrically by the magnetic clutch 45 and/or the disc rotor 44 and/or the drive shaft 43.

The orbiting scroll 50 includes a spiral scroll element 52 extended outwardly from the carrier plate 51 and also disposed and located within the chamber 12 of the casing 11 and disposed or arranged at an angular and radial offset from the spiral scroll element 33 of the fixed scroll 30 and arranged to form a line contact between the spiral scroll elements 33, 52 of the fixed scroll 30 and the orbiting scroll 50, and arranged for forming at least one pair of sealed off fluid pockets 80 within the chamber 12 of the casing 11 for forming or defining the chamber 12 or the fluid pockets 80 as a compressing or suction chamber 80, in which the relative orbital motion between the spiral scroll elements 33, 52 of the fixed scroll 30 and the orbiting scroll 50 may change the volume of the fluid pockets 80 to compress the fluid. The above-described structure is typical and will not be described in further details.

The cup shaped casing 11 of the compressor housing 10 includes an inlet port 16 and an outlet port 17 formed in the rearward end 13 of the casing 11, and the outlet port 17 is communicative with the compartment 14 of the casing 11, the fixed scroll 30 includes a protrusion 34, such as a curved protrusion 34 extended outwardly from the base plate 31 and extended and located opposite to the spiral scroll element 33 and disposed and located within the compartment 14 of the casing 11, and engaged with the rearward end 13 of the casing 11, and fixed or secured to the casing 11 with the fasteners 32 for spacing the base plate 31 from the rearward end 13 of the casing 11, and for forming or defining the compartment 14 of the casing 11 as a discharge chamber 14. The base plate 31 is arranged to seal and to separate the compartment 14 or the discharge chamber 14 and the chamber 12 or the fluid pockets 80 of the casing 11 from each other.

The fixed scroll 30 includes a fluid pocket or inlet mouth 35 formed therein or formed through the protrusion 34, and attached or mounted or coupled to the inlet port 16 of the casing 11 and offset or spaced or separated from the compartment 14 or the discharge chamber 14 of the casing 11 for receiving the fluid from the inlet port 16 of the casing 11 and for preventing the fluid from entering into the compartment 14 or the discharge chamber 14 of the casing 11, and the base plate 31 includes a fluid passage 36 formed therein (FIGS. 1, 2, 6) and formed through the base plate 31 and communicating with the inlet mouth 35 of the base plate 31 for allowing the fluid to flow from the inlet port 16 of the casing 11 into the inlet mouth 35 of the base plate 31, and then into the fluid pockets 80, and then to be compressed by the relative orbital motion between the spiral scroll elements 33, 52 of the fixed scroll 30 and the orbiting scroll 50.

Figure 6:
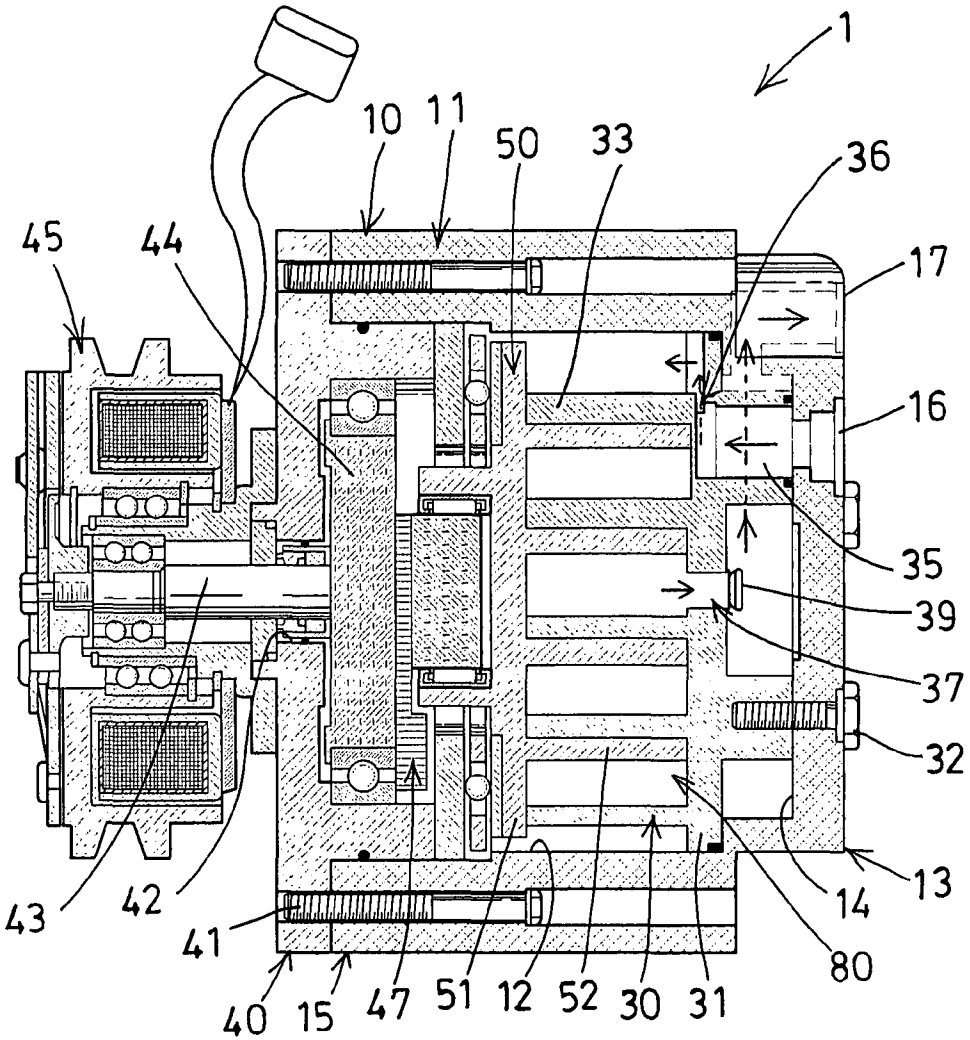
FIG. 6 is a cross sectional view similar to FIG. 1, illustrating the operation of the scroll compressor.

The base plate 31 further includes a discharge port 37 formed therein and formed through the base plate 31, and preferably but not necessarily formed in the center portion thereof, and communicating with both the compartment 14 or the discharge chamber 14 of the casing 11 and the chamber 12 or the fluid pockets 80 or the suction chamber 80 of the casing 11 for allowing the compressed fluid to flow from the fluid pockets 80 or the suction chamber 80 of the casing 11 through the discharge port 37 of the base plate 31 and then into the compartment 14 or the discharge chamber 14 of the casing 11 and then to flow out through the outlet port 17 of the casing 11, best shown in FIG. 6.

A reed or leaf valve device 39 is attached or mounted to the base plate 31 and engaged with the discharge port 37 of the base plate 31 for forming or acting as a check valve device 39 and arranged to limit the fluid to flow from the fluid pockets 80 or the suction chamber 80 of the casing 11 through the discharge port 37 of the base plate 31 and into the compartment 14 or the discharge chamber 14 of the casing 11 only, and to prevent the fluid from flowing backward from the compartment 14 or the discharge chamber 14 of the casing 11 into the fluid pockets 80 or the suction chamber 80 of the casing 11.

In operation, as shown in FIG. 6, the fluid supplied to the inlet port 16 of the casing 11 may be sucked or drawn into the inlet mouth 35 of the base plate 31, and then through the fluid passage 36 and then into the fluid pockets 80, and then to be compressed and sucked or drawn by the relative orbital motion between the spiral scroll elements 33, 52 of the fixed scroll 30 and the orbiting scroll 50, the compressed fluid may then be forced to flow from the fluid pockets 80 or the suction chamber 80 of the casing 11 through the discharge port 37 of the base plate 31 and then into the compartment 14 or the discharge chamber 14 of the casing 11 and then to flow out through the outlet port 17 of the casing 11.

It is to be noted that the inlet port 16 and the outlet port 17 may be easily and quickly formed in the rearward end 13 of the casing 11, and the inlet mouth 35 and the fluid passage 36 and the discharge port 37 may also be easily and quickly formed in the base plate 31, such that the scroll compressor 1 may be easily and quickly formed or manufactured and assembled without changing much structure of the scroll compressor 1, in addition, both the inlet port 16 and the outlet port 17 may be formed and arranged in the rearward end 13 of the casing 11 and may be easily and quickly coupled to the tubings or pipings of the vehicle (not shown) with the other tubings or pipings without bending or folding the other tubings or pipings.

Accordingly, the scroll compressor in accordance with the present invention includes a fluid inlet and a fluid outlet disposed or arranged rearwardly or at the rear portion of the compressor for allowing the compressor to be easily and quickly coupled to the tubings or pipings of the vehicle with the other tubings or pipings without bending or folding the other tubings or pipings, and for allowing the compressor to be easily and quickly secured or assembled or mounted within the tiny engine chamber of the vehicle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A scroll compressor comprising:

a compressor housing including a casing having a chamber formed in said casing for receiving a fluid, and having a rearward end, and having a compartment formed in said rearward end and communicative with said chamber of said casing, said casing including an inlet port formed in said rearward end of said casing, and including an outlet port formed in said rearward end of said casing and communicative with said compartment of said casing, a fixed scroll mounted within said chamber of said casing, and including a base plate fixed to said casing for separating said compartment and said chamber of said casing from each other, and including a spiral scroll element extended from said base plate and disposed and located within said chamber of said casing, and an orbiting scroll rotatably disposed and located within said chamber of said casing, and including a carrier plate, and including a spiral scroll element extended from said carrier plate and located within said chamber of said casing and arranged at an angular and radial offset from said spiral scroll element of said fixed scroll and arranged to form a line contact between said spiral scroll elements of said fixed scroll and said orbiting scroll, and arranged for forming a sealed off fluid pocket within said chamber of said casing, and said fixed scroll including an inlet mouth formed therein and coupled to said inlet port of said casing and separated from said compartment of said casing for receiving the fluid from said inlet port of said casing, and including a fluid passage formed through said base plate and communicative with said inlet mouth for allowing the fluid to flow from said inlet port of said casing into said inlet mouth of said base plate, and then into said fluid pocket, and then to be compressed into a compressed fluid by a relative orbital motion between said spiral scroll elements of said fixed scroll and said orbiting scroll, and said fixed scroll including a discharge port formed through said base plate and communicating said fluid pocket with said compartment of said casing for allowing the compressed fluid to flow from said fluid pocket into said compartment of said casing, and then to flow out through said outlet port of said casing, said fixed scroll including a protrusion extended from said base plate and extended and located opposite to said spiral scroll element of said fixed scroll and disposed and located within said compartment of said casing and engaged with said rearward end of said casing for spacing said base plate from said rearward end of said casing and for forming said compartment of said casing as a discharge chamber, and said inlet mouth being formed through said protrusion of said fixed scroll.

2. The scroll compressor as claimed in claim 1, wherein said base plate includes a valve device attached to said base plate and engaged with said discharge port of said base plate for limiting the fluid to flow from said fluid pocket of said casing through said discharge port of said base plate and into said compartment of said casing, and to prevent the fluid from flowing backward from said compartment into said fluid pocket of said casing.

3. The scroll compressor as claimed in claim 2, wherein said valve device is a leaf valve device and acted as a check valve device.

4. The scroll compressor as claimed in claim 1, wherein said compressor housing includes a front end plate mounted to a front portion of said casing, and includes an orifice formed in said front end plate, a drive shaft rotatably received and supported in said orifice of said front end plate, a disc rotor mounted to said drive shaft and disposed within said chamber of said casing, and a magnetic clutch coupled to said drive shaft for transmitting a rotation force to said drive shaft.

* * * * *